US010779582B2

(12) United States Patent
Ward et al.

(10) Patent No.: US 10,779,582 B2
(45) Date of Patent: Sep. 22, 2020

(54) PRESSURE-DISTRIBUTING UNDERGARMENT WITH FASTENING SYSTEM

(71) Applicant: LULULEMON ATHLETICA CANADA INC., Vancouver (CA)

(72) Inventors: Rebecca Claire Ward, Vancouver (CA); Alexandra Carmela Plante, Vancouver (CA); Laura Renee Dixon, Vancouver (CA); Erica Margaret Buckeridge, Vancouver (CA)

(73) Assignee: LULULEMON ATHLETICA CANADA INC. (CA)

( * ) Notice: Subject to any disclaimer, the term of this patent is extended or adjusted under 35 U.S.C. 154(b) by 285 days.

(21) Appl. No.: 15/708,648

(22) Filed: Sep. 19, 2017

(65) Prior Publication Data

US 2019/0082749 A1 Mar. 21, 2019

(51) Int. Cl.

| | |
|---|---|
| ***A41C 3/12*** | (2006.01) |
| ***A41C 3/00*** | (2006.01) |
| ***A41F 15/00*** | (2006.01) |

(52) U.S. Cl.

CPC ..... *A41C 3/0057* (2013.01); *A41C 3/12* (2013.01); *A41F 15/002* (2013.01)

(58) Field of Classification Search

CPC ..... A41C 3/0057; A41C 3/12; A41F 15/002
USPC ..... 450/54–57, 39
See application file for complete search history.

(56) References Cited

U.S. PATENT DOCUMENTS

| | | | | |
|---|---|---|---|---|
| 4,311,150 | A * | 1/1982 | Schreiber | A41C 3/0057 450/70 |
| 6,023,785 | A * | 2/2000 | Johnson | A41C 3/0057 2/62 |
| 8,142,256 | B2 | 3/2012 | Rose et al. | |
| 9,210,955 | B2 | 12/2015 | Dandapure et al. | |
| 2002/0022433 | A1 | 2/2002 | Yeung et al. | |
| 2005/0005640 | A1* | 1/2005 | Davidi | A44C 17/001 63/32 |
| 2006/0243000 | A1 | 11/2006 | Turlan et al. | |
| 2007/0155283 | A1* | 7/2007 | McQueer | A41C 3/0057 450/39 |
| 2011/0177757 | A1 | 7/2011 | Swendseid | |

(Continued)

FOREIGN PATENT DOCUMENTS

CN 207023276 U 2/2018

OTHER PUBLICATIONS

International Search Report and Written Opinion for related PCT application PCT/US2018/051293 dated Nov. 28, 2018.
Lululemon, "Enlite Bra", shop.lululemon.com, 2017, p. 1.

*Primary Examiner* — Gloria M Hale
(74) *Attorney, Agent, or Firm* — Bracewell LLP; Douglas F. Stewart; Patrick J. Connolly

(57) ABSTRACT

This invention relates to undergarments for use in active environments, where the wearer of such an undergarment is engaged in an activity that requires accelerating movements. In some preferred embodiments, these undergarments may be sports bras constructed from a stiffened or reinforced material and may include decoupled, damping cups for supporting breast tissue, and a fastening system incorporated into a reinforced underband that allows the wearer to more easily wear and remove the undergarment without compromising underband support.

21 Claims, 7 Drawing Sheets

(56) References Cited

U.S. PATENT DOCUMENTS

| | | | | |
|---|---|---|---|---|
| 2012/0122370 | A1* | 5/2012 | Heath | A41C 3/0057<br>450/80 |
| 2013/0203319 | A1* | 8/2013 | Torres | A41C 3/0028<br>450/59 |
| 2013/0316615 | A1* | 11/2013 | Hurd | A41C 3/0057<br>450/39 |
| 2015/0056890 | A1* | 2/2015 | Black | A41C 3/0057<br>450/86 |
| 2016/0044971 | A1* | 2/2016 | Randall | A41C 3/142<br>450/39 |
| 2017/0290377 | A1* | 10/2017 | Liu | A41C 5/005 |
| 2018/0132541 | A1* | 5/2018 | Wittstadt | A41C 3/0035 |

* cited by examiner

PRESSURE-DISTRIBUTING UNDERGARMENT WITH FASTENING SYSTEM

FIELD OF INVENTION

This invention relates to undergarments for use in active environments, where the wearer of such an undergarment is engaged in an activity incorporating accelerating movements. In some preferred embodiments, these undergarments may be sports bras constructed from a stiffened or reinforced material and may include decoupled, damping cups for supporting breast tissue, and a fastening system incorporated into a reinforced underband that allows the wearer to more easily wear and remove the undergarment without compromising underband support.

BACKGROUND OF THE INVENTION

Typical sports bras are designed to restrict the movement of breast tissue related to high-impact exercise by uniformly compressing the breast tissue to the wearer's chest. While the uniform compression effected by a typical sports bra may provide acceptable movement management of the breast tissue, this compression can also be extremely uncomfortable for the wearer because it does not effectively distribute the pressure around the wearer's torso. This discomfort is typically experienced by a wearer around their back and shoulders. The compression provided by a typical sports bra effectively compacts the wearer's breast tissue to the wearer's chest, and does not allow for decoupled or dampened movement of the breast tissue that may be more comfortable for the wearer. By failing to provide dampened and decoupled movement, and failing to distribute pressure in more comfortable fashion, a typical sports bra does not effectively maximize the balance between maintaining the comfort of the wearer and managing movement of the wearer's breast tissue.

Furthermore, while typical sports bras constructed from stiffened or reinforced materials may provide adequate compression and support, they typically do not incorporate a fastening mechanism that can allow a wearer to easily put on or remove the bra. Even when a sports bra of this type incorporates a fastener, this type of bra does not open sufficiently when unfastened, to allow the user to easily put on or remove the bra.

There exists a need for an undergarment that provides dampened and decoupled management of the acceleration and movement of breast tissue during high-impact exercise, while distributing pressure in a way that is more comfortable for the wearer of the undergarment. There also exists a need for a reinforced undergarment made from stiffened material that incorporates a fastening system that opens in a way that allows the undergarment can be easily worn or removed by the wearer.

SUMMARY OF THE INVENTION

The present invention provides an undergarment that distributes pressure in a way that is comfortable for the wearer while also effectively managing and reducing movement and acceleration of the wearer's breast tissue through damping and decoupling structures. In some preferred embodiments, the undergarment comprises cups that provide damping support for the wearer's breast tissue while also allowing decoupled movement of each of the wearer's breasts.

The present invention also provides a fastening system for an undergarment with a reinforced underband that opens wide enough in the back thereby allowing a wearer to effectively and easily put on and remove the undergarment.

BRIEF DESCRIPTION OF THE DRAWINGS

The accompanying drawings are fully incorporated in, and form part of, this specification, and illustrate embodiments of the invention that, together with the description, serve to explain principles of the invention.

DETAILED DESCRIPTION

Reference will now be made in detail to embodiments of the invention, examples of which are illustrated in the accompanying drawings. While the invention is described in conjunction with these embodiments, it will be understood that the descriptions herein are not intended to limit the invention to these embodiments. On the contrary, the invention is intended to cover alternatives, modifications, and equivalents that may be included within the spirit and scope of the invention as defined by the appended claims. Detailed description of components that are well known in the art may be omitted if that detailed description would confuse or obscure the description of the embodiments of the present invention.

Figure 1:
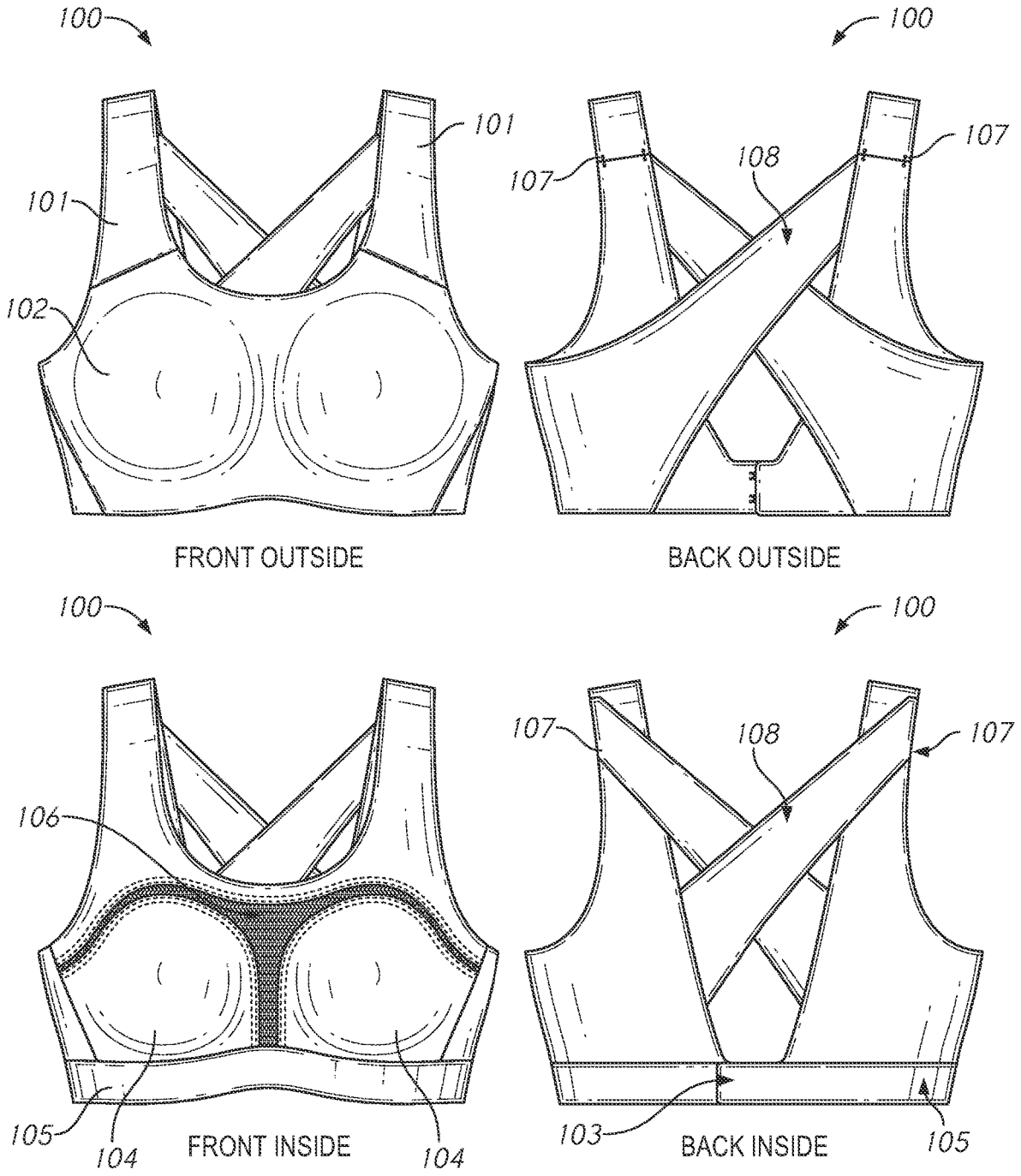
FIG. 1 depicts an example embodiment of a pressure-distributing undergarment according to the invention.

FIG. 1 depicts four perspectives showing the inside and outside of an example embodiment of a pressure-distributing undergarment 100 according to the invention. As depicted, undergarment 100 includes: front straps 101, front panel 102, fastening system 103, cups 104, underband 105, decoupling panel 106, cross back straps 107, and back strap decoupled area 108.

Undergarment 100 is depicted with fastening system 103 engaged such that underband 105 is closed. In this engaged position, underband 105 provides compression and support for the wearer that relieves pressure from the shoulders and back. As will be described elsewhere, when fastening system 103 is not engaged, underband 105 is permitted to open widely and completely to allow the wearer to easily put on or remove undergarment 100 because cross backstraps 107 are decoupled.

From the outside perspective, the front of undergarment 100 appears as single front panel 102. The inside perspective of the front of undergarment 100 reveals cups 104 which are integrated into decoupling panel 106. Decoupling panel 106 may be a different layer and may be a different material than that of front panel 102. As will be described elsewhere, cups 104 provide damping support and compression for the wearer of undergarment 100. Additionally, through integration with decoupling panel 106, cups 104 allow for decoupled movement of the wearer's breast tissue. This combination of compression, damping, and decoupling provides superior comfort and support for the wearer of undergarment 100.

The pressure distributing undergarment may be constructed from a variety of materials. In some embodiments, the undergarment may be constructed from neoprene, spandex, lycra, nylon, rayon, cotton, or combinations thereof.

Figure 2:
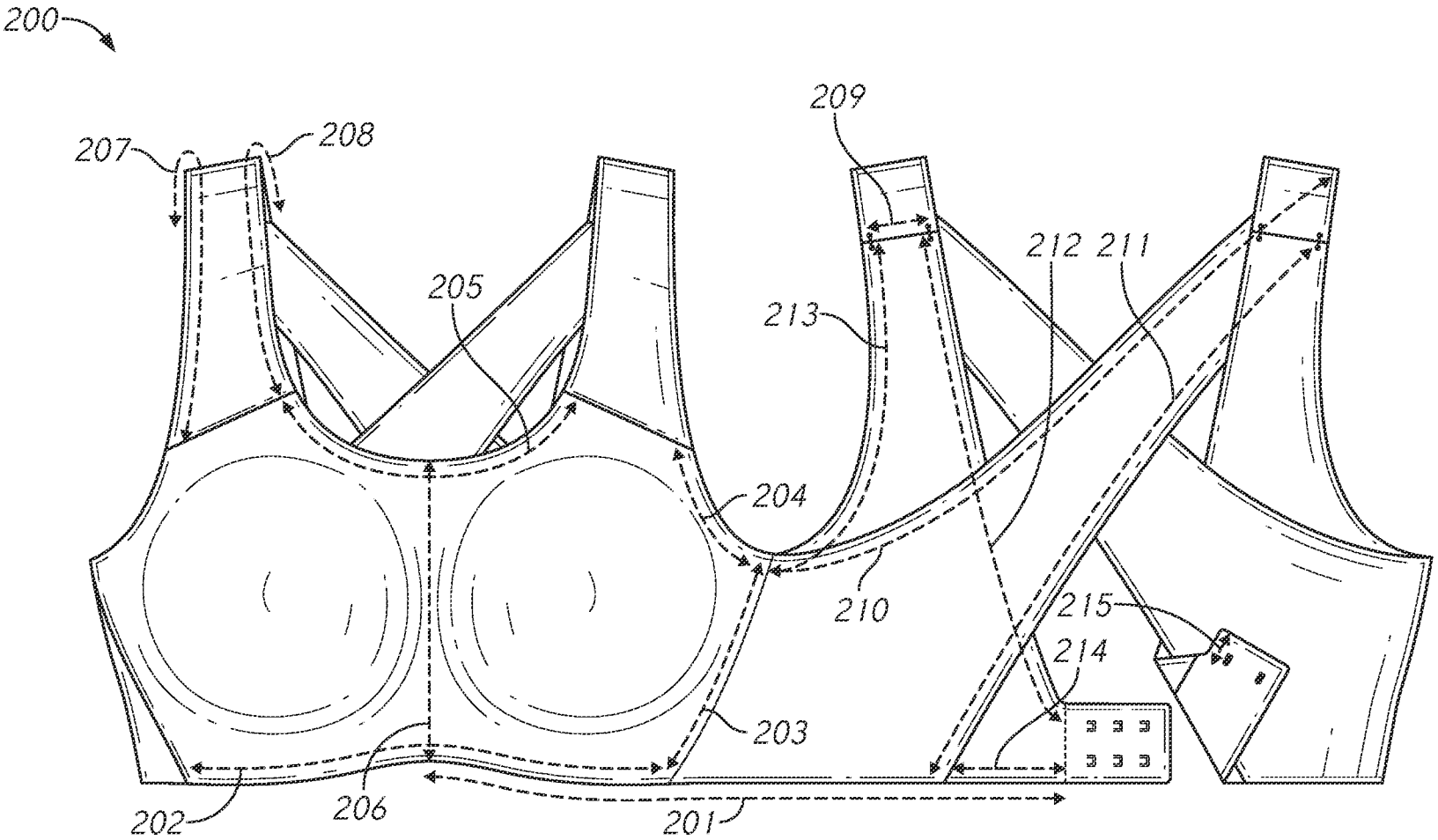
FIG. 2 depicts an expanded view of an example embodiment of a pressure-distributing undergarment according to the invention.

FIG. 2 depicts an expanded view of the outside an example embodiment of a pressure-distributing undergarment according to the invention, which is unrolled in one direction to show different measured aspects of the undergarment. As depicted, undergarment 200 includes: half underband in a relaxed state 201, cradle 202, side seam 203, front armhole 204, front neck edge 205, center front 206, inner front strap 207, outer front strap 208, strap width 209, top cross strap 210, bottom cross strap 211, inner straight strap 212, outer straight strap 213, strap-to-fastening system region 214, and fastening tab 215.

As depicted in FIG. 2, the fastening system of undergarment 200 is not engaged. In this example embodiment, the fastening system is illustrated as hooks on fastening tab 215 that engage with eyes located on a tab at the end of strap-to-fastening system 214. In other example embodiments, the fastening system may be comprised of snaps, Velcro, buckles, or other equivalent fastening mechanisms.

Figure 3A:
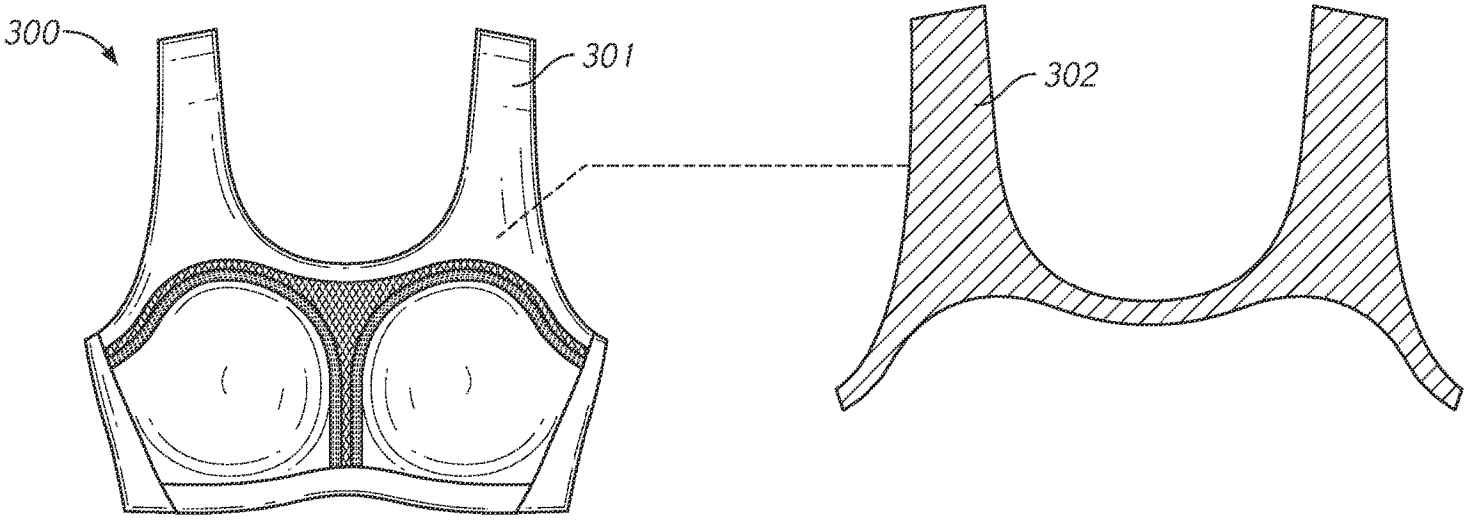
FIGS. 3A and 3B depict example material reinforcements for an example embodiment of a pressure-distributing undergarment according to the invention.
Figure 3B:
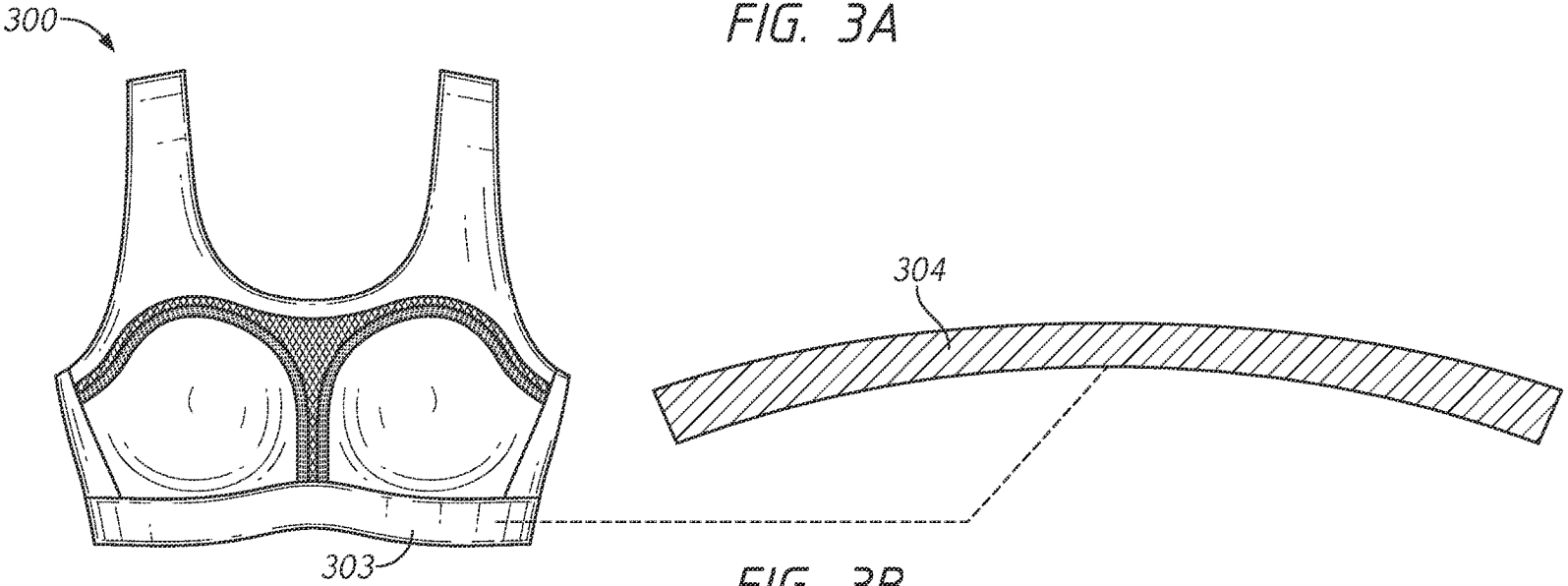

FIGS. 3A and 3B depict example material reinforcements for an example embodiment of a pressure-distributing undergarment 300 according to the invention. As depicted undergarment 300 includes: front strap panel 301, front strap panel reinforcement 301, underband panel 303, and underband panel reinforcement 304.

In some embodiments of the invention, specific panels, strips, straps, or portions that comprise the pressure-distributing undergarment may be reinforced or stiffened with additional layers of material. In certain embodiments the undergarment materials may be reinforced by bonding, fusing, or gluing together adhesive-backed fabrics to specific portions or locations in the undergarment. In other example embodiments the undergarment may be reinforced using other methods, for example, intarsia or traditional cut-and-sew techniques. FIG. 3A depicts undergarment 300 in which front strap panel 301 is reinforced with front strap panel reinforcement. FIG. 3B depicts undergarment 300 in which underband panel 303 is reinforced with underband panel reinforcement 304. Because these sections are reinforced, these portions are stiffer than portions of undergarment 300 that are not reinforced. When undergarment 300 is put on by the wearer, these reinforced portions may provide support through compression while distributing pressure across the torso of the wearer. In some embodiments, the portions of the undergarment that are selected to be reinforced are chosen to relieve pressure from the wearer's shoulders and back.

FIGS. 4A, 4B, 4C, 4D, and 4E depict example material reinforcements for a pressure-distributing undergarment 400 according to the invention. As depicted undergarment 400 includes: apex seam section 401, apex seam reinforcement panel 402, inner underband section 403, inner underband reinforcement panel 404, back wing sections 405 and 407, back wing reinforcement panels 406 and 408, back strap triangle 409, back strap triangle reinforcement panel 410, side seam strip 411, side seam strip reinforcement panel 412, fastening system sections 413 and 415, and fastening system reinforcement panels 414 and 416.

Figure 4A:
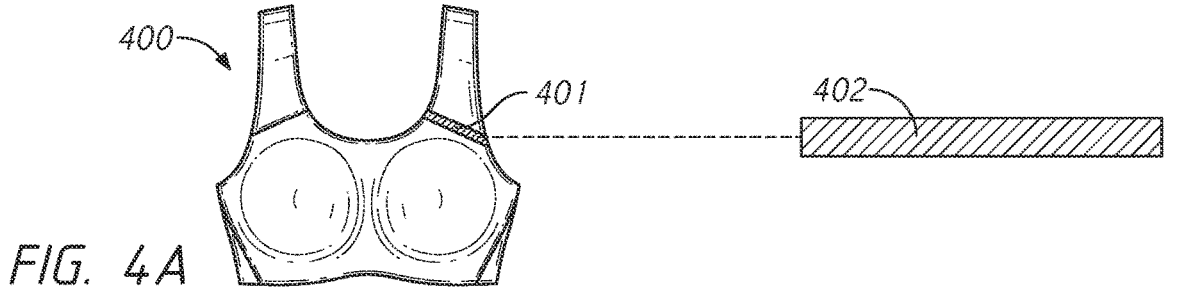
FIGS. 4A, 4B, 4C, 4D, and 4E depict example material reinforcements for a pressure-distributing undergarment according to the invention.
Figure 4B:
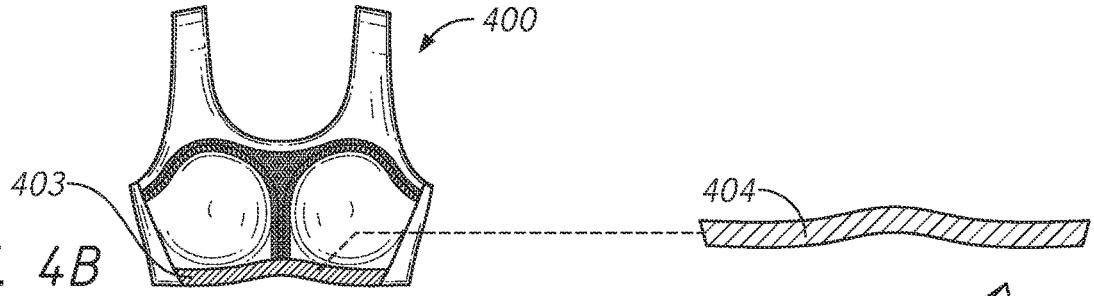
Figure 4C:
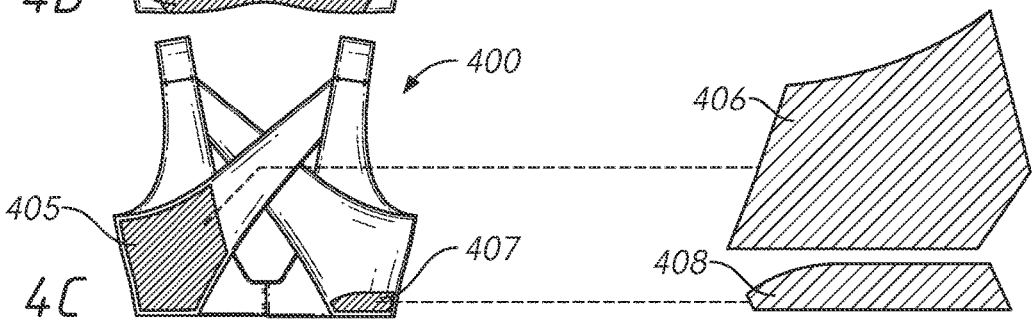
Figure 4D:
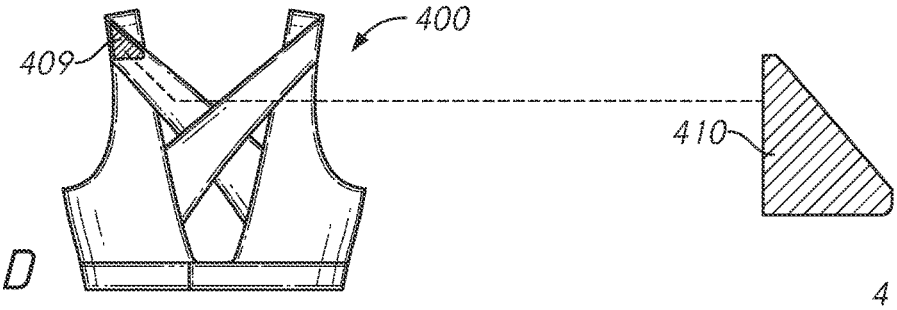
Figure 4E:
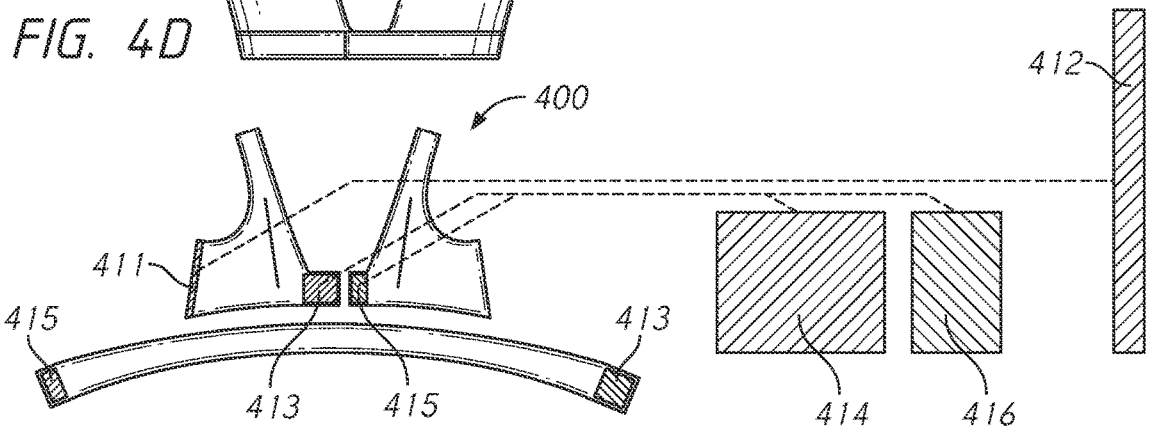

As discussed above with respect to FIGS. 3A and 3B, a number of techniques may be used to reinforce various portions and locations of the pressure-distributing undergarment. FIGS. 4A-4E depict example embodiments of undergarment 400 that include these reinforced portions. In FIG. 4A, apex seam section 401 is reinforced with apex seam reinforcement panel 402. In FIG. 4B, inner underband section 403 is reinforced with inner underband reinforcement panel 404. In FIG. 4C, back wing sections 405 and 407 are reinforced with back wing reinforcement panels 406 and 408. In FIG. 4D, back strap triangle 409 is reinforced with back strap triangle reinforcement panel 410. In FIG. 4E, side seam strip 411 is reinforced with side seam strip reinforcement panel 412, and fastening system section 413 and 415 are reinforced with fastening system reinforcement panels 414 and 416. As described above, these reinforced undergarment sections may be chosen to optimize both compression support and comfort for the wearer. As such, some combination of reinforcements may be chosen in order to optimize the effectiveness of the undergarment for the wearer.

It should be noted that the example embodiment pressure-distributing undergarments depicted in FIGS. 3A, 3B, and 4A-4E do not include reinforcements for the back straps. In these example embodiments, when the fastening system for the undergarment is not engaged, the decoupled, unreinforced back straps allow the underband to open widely so that the wearer can put on or remove the pressure-distributing undergarment more easily.

Figure 5:
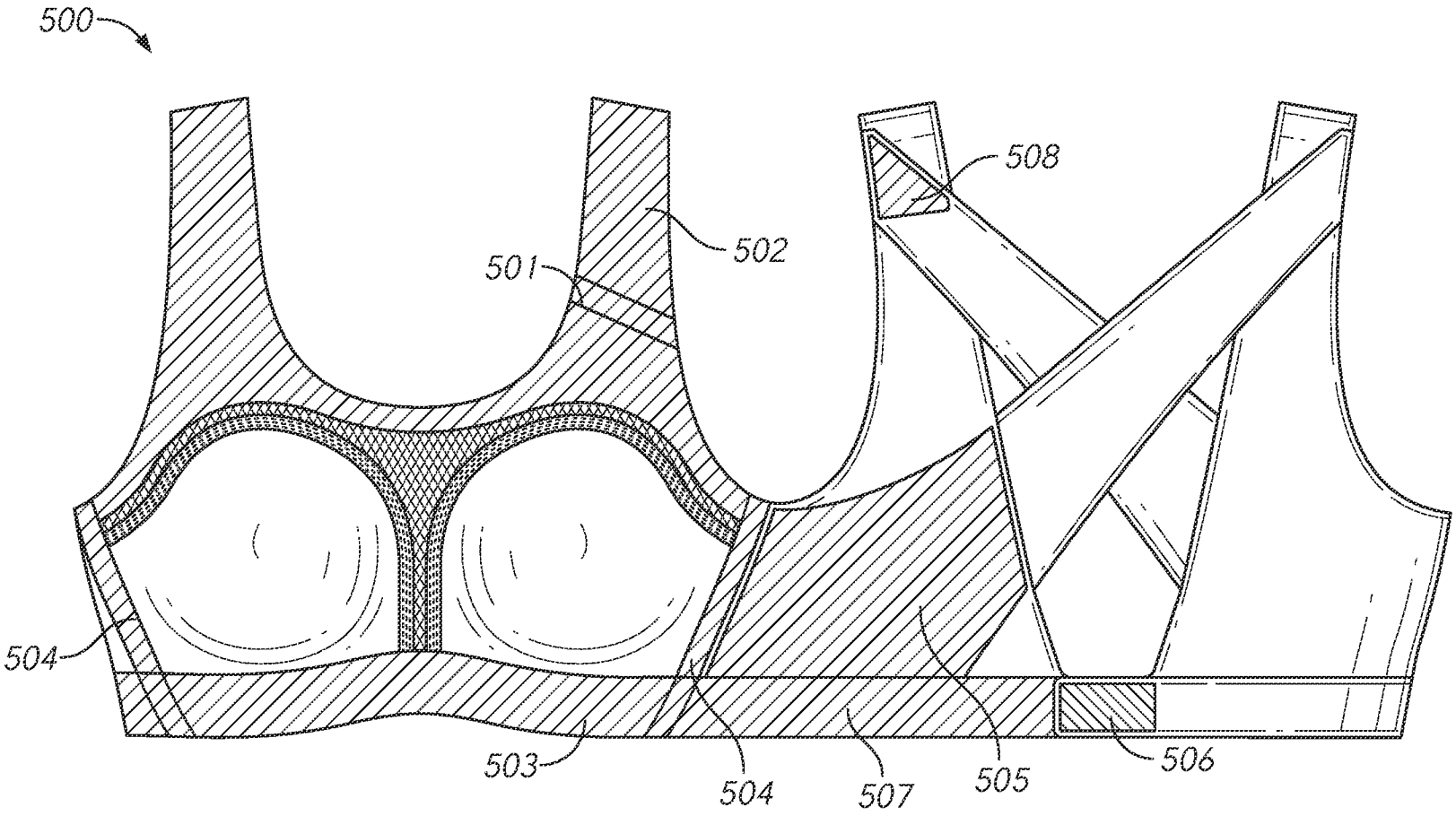
FIG. 5 depicts an expanded view of an example embodiment of a pressure-distributing undergarment with reinforced sections according to the invention.

FIG. 5 depicts an expanded view of an example embodiment of a pressure-distributing undergarment 500 with reinforced sections according to the invention. As depicted, undergarment 500 includes: apex seam section 501, front panel 502, inner underband 503, side stream strips 504, back wing panel 505, fastening system section 506, underband 507, and back strap triangle 508.

As depicted in FIG. 5, the fastening system corresponding to fastening system section 506 is engaged. The fastening system may be comprised of hooks and eyes, snaps, Velcro, buckles, or other equivalents. As described above with respect to FIGS. 3A, 3B, and 4A-4E, this example embodiment pressure-distributing undergarment 500 does not include reinforced material on the backstraps, which are decoupled. This flexibility and decoupling allows the user to more easily put on or remove undergarment 500 when the fastening system is not engaged.

Figure 6A:
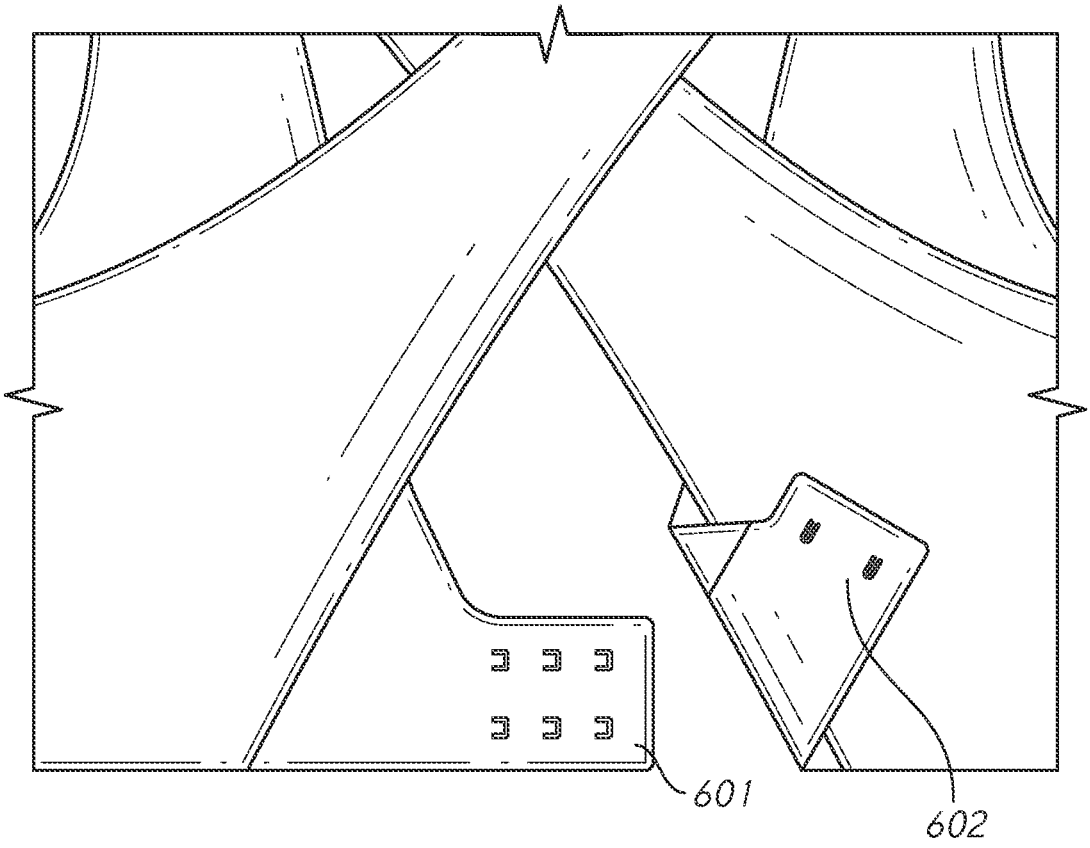
FIGS. 6A and 6B depict an example embodiment of a fastening system for a pressure-distributing undergarment according to the invention.
Figure 6B:
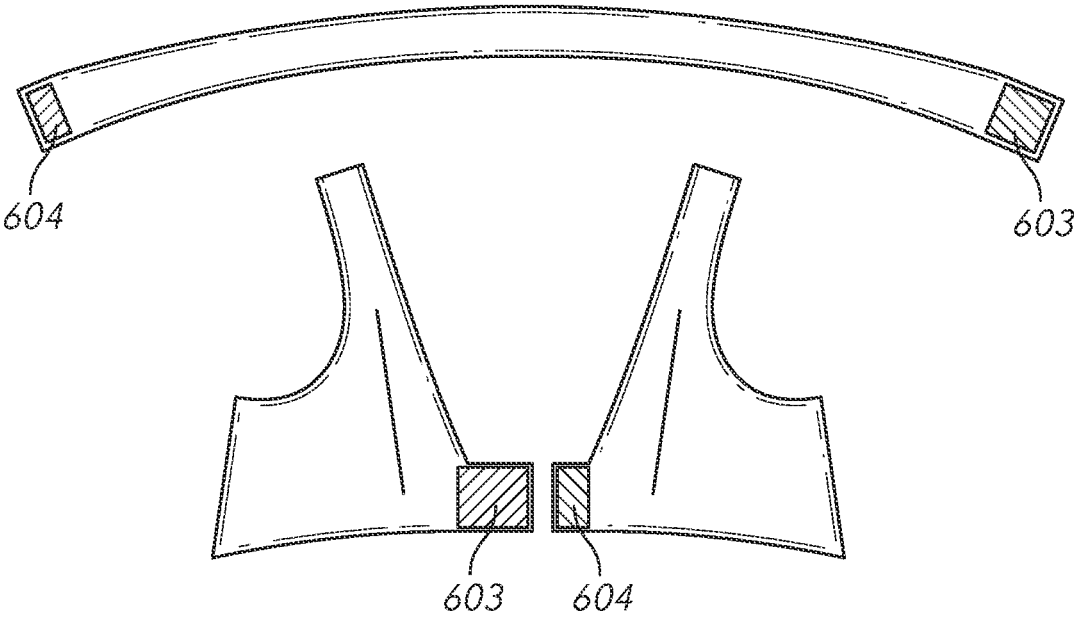

FIGS. 6A and 6B depict an example embodiment of a fastening system for a pressure-distributing undergarment 600 according to the invention. As depicted, undergarment 600 includes: eye section 601, hook section 602, fastening section 603, and fastening section 604.

As described above with respect to other figures, while a hook and eye fastening system is depicted in FIG. 6A, other equivalent fastening technologies may be used. FIG. 6B illustrates that fastening sections 603 and 604 may be reinforced on both the underband and the back side panels of the undergarment in order to better provide security for the fastening system.

Figure 7A:
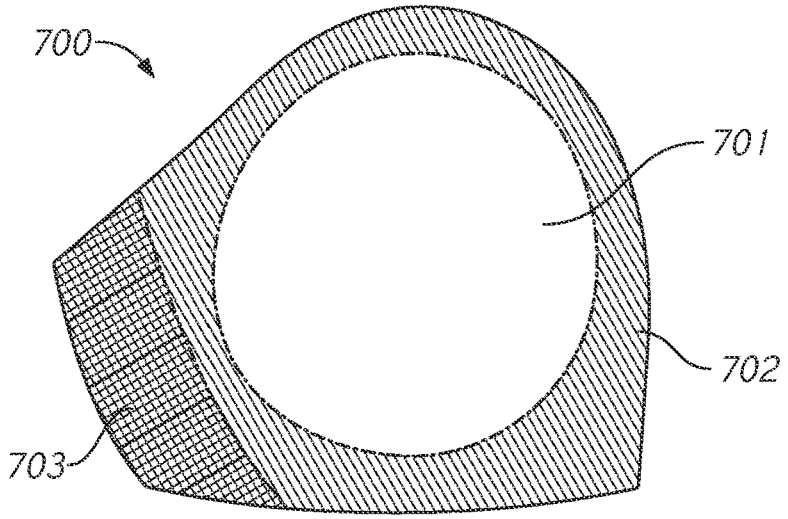
FIGS. 7A, 7B, and 7C depict example embodiments of a damping cup for use with a pressure-distributing undergarment according to the invention.
Figure 7B:
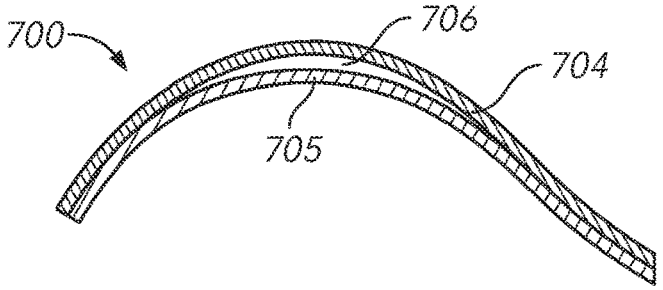
Figure 7C:
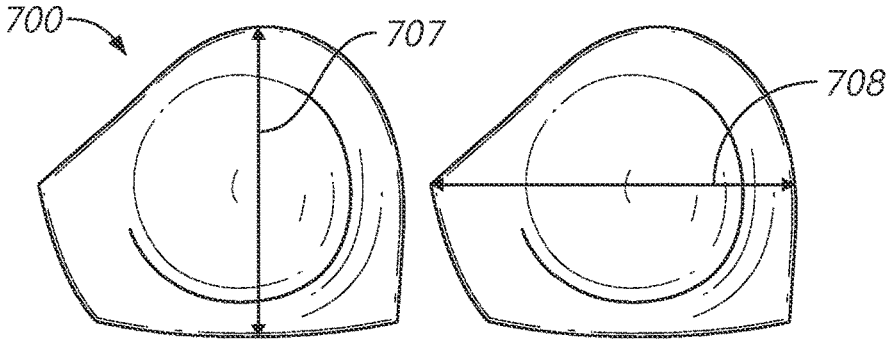

FIGS. 7A, 7B, and 7C depict example embodiments of a damping cup 700 for use with a pressure-distributing undergarment according to the invention. As depicted, damping cup 700 includes: air pocket region 701, bonded area 702, compression area 703, outer layer 704, inner layer 705, air pocket 707, outer layer grain line 707, and inner layer grain line 708.

As depicted in FIG. 7A, damping cup 700 includes air pocket region 701, bonded area 702, and compression area 703. Compression area 703 may be reinforced with additional, as discussed with respect to embodiments described above.

FIG. 7B depicts a cutaway side view of a damping cup 700, and depicts air pocket 706 that is formed between outer layer 704 and inner layer 705. As depicted in FIG. 7B, outer layer 704 and inner layer 705 may be bonded, fused, or glued together in order to form air pocket 706. Outer layer 704 and inner layer 705 may have different mold depths, such that outer layer 704 is molded more than inner layer 705 in order to form air pocket 706 between them. Creating an air pocket between the damping cup layers creates a damping system that absorbs and mitigates the motion of the wearer's breast tissue in a direction projecting outwards from the wearer's chest and torso. A direction projecting outwards is understood to include any movement on a vector originating from a point on the wearer's chest or torso.

FIG. 7C depicts the grain direction of material used for the inner and outer layers of damping cup 700. Grain direction 707 indicates that the grain of the material used for the outer layer of damping cup 700 should be perpendicular to grain direction 708 of the material used for the inner layer of damping cup 700. In other embodiments than those depicted, configurations with different relative grain orientations of the inner and outer layer materials may be employed.

As described above with respect to other embodiments of the pressure-distributing under garment, damping cups may be integrated into the pressure-distributing undergarment in a decoupled manner that allows the wearer's breasts to move independently from each other. This decoupled compression both provides support and comfort for the wearer of the pressure-distributing undergarment.

Although a number of example embodiments of the invention have been described, it should be understood that numerous other modifications and embodiments of the invention can be devised by those skilled in the art that will fall within the scope of the principles of this disclosure. More particularly, various variations and modifications are possible in the component parts and/or arrangements of the inventive subject matter within the scope of the disclosure, the drawings, and the appended claims. In addition to variations and modifications in the component parts and/or arrangements, alternative uses and applications of the invention will also be apparent to those skilled in the art.

What is claimed is:

1. An article of apparel comprising:

a front panel with front straps;

damping cups sized to encompass a wearer's breast tissue and configured to absorb accelerating movements in a direction outward from a wearer's torso, the damping cups being integrated into a decoupling panel allowing decoupled movement of the wearer's breast tissue;

back straps comprising cross back straps with a decoupled area allowing the cross back straps to be decoupled; and a reinforced underband with a fastening system, wherein when the fastening system is disengaged, the combination of the reinforced underband with the decoupling of the back straps allows the reinforced underband to open to allow the wearer to put on or remove the article of apparel.

2. The article of apparel according to claim 1, wherein the decoupling panel decouples the damping cups so as to allow breast tissue of the wearer to move independently from each other.

3. The article of apparel according to claim 1, wherein each of the damping cups further comprises an outer layer and an inner layer, the outer layer and the inner layer being molded, the outer layer having a greater mold depth than the mold depth of the inner layer such that an air gap is formed between the outer and the inner layer of each damping cup.

4. The article of apparel according to claim 3, wherein each air gap is formed by fusing the outer molded layer and the inner molded layer at a bonding area, the bonding area surrounding and defining the air gap.

5. The article of apparel according to claim 4, wherein the outer molded layer has a different curvature than the curvature of the inner molded layer.

6. The article of apparel according to claim 1 wherein the fastening system based on a hook and eye interface.

7. The article of apparel according to claim 1, wherein the underband is reinforced by gluing together layers of material.

8. The article of apparel according to claim 1, wherein the amount of reinforcement in the underband is greater than the amount of reinforcement in the back straps.

9. A system for managing accelerating movements of breast tissue comprising:

a damping system comprising damping cups sized to encompass a wearer's breast tissue and configured to absorb and dampen movement of the breast tissue in a direction that is outward from a wearer's chest and torso and a decoupling panel integrated with the damping cups configured to allow decoupled movement of the wearer's breast tissue; and a compression system configured to compress portions of the wearer's torso while relieving pressure from the wearer's back and shoulders.

10. The system of claim 9, wherein the damping cups each have two layers of material and integrated air pockets formed between two layers.

11. The system of claim 10, wherein the two layers of material that have been fused together in an area surrounding the air pockets.

12. The system of claim 9, wherein the compression system includes a reinforced underband with an integrated fastening system.

13. The system of claim 12, wherein the fastening system is configured to allow the reinforced underband to open.

14. The system of claim 9, wherein the compression system comprises back straps.

15. The system of claim 14, wherein the back straps are configured to cross each other, the cross back straps not being attached one to the other at the cross section forming a back strap decoupled area.

16. The system of claim 14 wherein the back straps are not reinforced.

17. A method for controlling accelerating movements of breast tissue on a torso of an individual:

damping the acceleration of the breast tissue in a direction that is outward from the torso by using damping cups sized to encompass the individual's first and second breasts; and decoupling the motion of the breast tissue using a decoupling panel integrated with the damping cups such that the first and second breast can move in different directions.

18. The method of claim 17, wherein damping is performed by damping cups with integrated air pockets, each damping cup configured to encompass a separate area of breast tissue.

19. The article of apparel of claim 1, wherein the front straps are reinforced.

20. The article of apparel of claim 1, further comprising at least one additional reinforcement section.

21. The article of apparel of claim 20, wherein the at least one additional reinforcement section is selected from: a front strap reinforcement section, an apex seam reinforcement section, a back wing reinforcement section, a back strap triangle reinforcement section, or a side seam strip reinforcement section.

* * * * *